US008939212B1

(12) United States Patent
Arning

(10) Patent No.: US 8,939,212 B1
(45) Date of Patent: Jan. 27, 2015

(54) CORROSION BARRIER CAP SYSTEM

(76) Inventor: Michael Dean Arning, Webster, TX (US)

( * ) Notice: Subject to any disclaimer, the term of this patent is extended or adjusted under 35 U.S.C. 154(b) by 1031 days.

(21) Appl. No.: 12/590,730

(22) Filed: Nov. 16, 2009

Related U.S. Application Data

(60) Provisional application No. 61/210,937, filed on Mar. 24, 2009, provisional application No. 61/216,237, filed on May 14, 2009.

(51) Int. Cl.
*E21B 29/12* (2006.01)

(52) U.S. Cl.
USPC ..... 166/335; 166/341; 166/343; 166/360

(58) Field of Classification Search
CPC ..... E21B 33/0375
USPC ..... 166/75.13, 79.1, 75.15, 92.1, 93.1, 166/94.1, 97.1, 335, 339–341, 343, 360, 166/368
See application file for complete search history.

(56) References Cited

U.S. PATENT DOCUMENTS

| | | | | |
|---|---|---|---|---|
| 5,992,526 | A * | 11/1999 | Cunningham et al. | 166/343 |
| 6,615,923 | B1 * | 9/2003 | Lay et al. | 166/368 |
| 6,817,417 | B2 | 11/2004 | Blair et al. | |
| 6,845,815 | B2 * | 1/2005 | Hergarden et al. | 166/92.1 |
| 7,051,804 | B1 | 5/2006 | Arning | |
| 7,325,598 | B2 * | 2/2008 | Bartlett | 166/75.13 |
| 2002/0185279 | A1 * | 12/2002 | Blair et al. | 166/335 |
| 2006/0272829 | A1 * | 12/2006 | Larsen | 166/387 |
| 2008/0190621 | A1 * | 8/2008 | Huang et al. | 166/339 |

* cited by examiner

*Primary Examiner* — James Sayre
(74) *Attorney, Agent, or Firm* — Karen B. Tripp

(57) ABSTRACT

A subsea cap method and system having a canister attached to a port in a subsea cap that is positioned on a subsea structure and materials contained within the canister for release through the port into the defined area beneath the subsea cap and around the open upper end of the subsea structure. That is, the materials treat the water inside the cap and may optionally also treat the water outside the cap. The canister can be attached to, or removed from, the subsea cap subsea without removing the subsea cap from its resting place on the subsea structure. The system can be deployed via an ROV, diver or other means. The positioning of the subsea cap on the subsea structure and the placement and active or passive release of the material through the port into the defined area provides a system that protects the subsea structure from such problems as falling debris, silt, corrosion and organic growth while saving valuable time and resources.

2 Claims, 5 Drawing Sheets

CORROSION BARRIER CAP SYSTEM

RELATED APPLICATIONS

This application is a non-provisional application claiming the benefit of U.S. Provisional Patent Application Ser. No. 61/210,937 filed Mar. 24, 2009, and Provisional Patent Application Ser. No. 61/216,237, filed May 14, 2009.

BACKGROUND OF THE INVENTION

1. Field of the Invention

The present invention relates to the delivery of treatment material to, and treatment of, the area contained within and around a subsea cap that protects the top of a subsea structure.

2. Description of Relevant Art

In offshore oil and gas exploration and development, a subsea well is drilled and data from the well is collected and analyzed to determine the amount of oil and gas in the area. While the data is being reviewed, drilling operations are suspended. The floating rig is disconnected from the subsea well and the subsea structure is left exposed 5 to 15 feet above the ocean floor for several months or years while the data is analyzed. This period is deemed temporary abandonment. To protect the subsea structure against falling debris and silt during this temporary abandonment, a subsea cap is installed on top of the exposed subsea structure. Critical working components of the subsea structure are guarded from corrosion via corrosion inhibitor material that is put into the stagnant area within the subsea cap via containers hung underneath the subsea cap or pumped in through an umbilical. None of these add treatment to the external profile of the wellhead which has a critical locking profile.

In addition, during suspension of a drilling operation, the well operator may return to the well to perform routine well maintenance or other work at the well site including taking measurements of internal components (such as, for example, casing hangers) and installing additional components while the drilling rig is away. In this process, the well operator deploys an ROV to the well site. The ROV is meant by way of example and is not meant to limit the scope of the invention. Other methods such as divers are also used. The ROV then descends to measure critical components inside the subsea structure. During these operations, the subsea cap must be removed and previously treated water is allowed to escape. The subsea cap is then either brought to the surface to be reloaded with new corrosion inhibitor or re-injected with corrosion inhibitor such as through an umbilical line connected or otherwise associated with one or more pumps, bladders, drums of corrosion inhibition chemicals and interfacing tools. The removal of the subsea cap to replenish the chemical under the cap leaves the structure exposed to falling objects and silt and can cause protracted ROV deployment times which in turn can lead to extended periods of down time, lengthy delays, and increased costs. Injecting fluid through an umbilical also causes delays as the ROV must surface and change tooling to accomplish this additional task, involving one or more pumps, bladders, drums of chemicals and interfacing tools.

The potential for extensive time and money loss involved in subsea cap removal and recovery, treatment-material recharging, and subsea cap replacement exhibits a clear need for a subsea cap system with the ability to be charged and recharged with treatment materials without removal, recovery and reinstallation of the subsea cap, and without additional tooling, trips to the surface and handling of chemical drums.

Therefore, it is a goal of this invention to provide an improved system to treat and maintain the internal and external working components of an exposed subsea structure while also protecting the subsea structure from falling debris and silt and from marine growth. It is also a goal of the present invention to provide an improved method of treating the area beneath a subsea cap, defined as the space within the open upper portion of a subsea structure and the area within the body of a subsea cap and the upper external profile of the subsea structure, including, but not limited to, a wellhead.

It also is an object of this invention to provide an alternative to the current method of treating stagnant areas beneath a subsea cap by fixedly suspending at least one treatment-material-loaded container from the underside of a subsea cap as described in U.S. Pat. No. 6,817,417 (invented by Blair et al. and filed Mar. 1, 2002). If there is a problem during the dive or installation, the ROV may have to return to the surface before installing the cap containing the treatment material. If the treatment material has been activated, such as from exposure to water, the treatment material can disburse into non-intended areas such as around the diver or workers trouble shooting and repairing the equipment, potentially making an unsafe work site.

Additionally, it is an object of the present invention to deliver treatment material, regardless of its current state (solid, liquid, gel, gas, etc.) and without removing the subsea cap to load or reload the treatment material, involving for example, one or more pumps, bladders, drums of chemicals, and interfacing tools. Another object is to provide a means to quickly install a replacement container if the cap has to be temporarily removed for well inspection or other reason. ROV recovery time from 5,000 feet is an average of about 100 feet per minute. If a cap has to be recovered to add more material at the surface, ascent of the ROV takes about 50 minutes, adding more material to the container (such as a basket) takes about 20 minutes, and the descent back to the subsea structure takes about another 50 minutes. It is an object of this invention to deliver and install another canister when the ROV or diver or other means goes to re-install the cap after inspection or after installing other hardware, without having to resurface for tooling or obtaining treatment material from drums. This canister installation would take a few minutes instead of the approximate 2 hours described above.

It is another object of the present invention to provide a method and system that does not require a conventional umbilical line or associated pumps, bladders, drums of chemical or interfacing tools to pump treatment material into the space beneath a subsea cap as described in U.S. Pat. No. 7,051,804 (invented by Arning and filed May 16, 2003).

SUMMARY OF THE INVENTION

The present invention provides a subsea cap system for inserting treating material into the area around the top of a subsea structure, comprising a subsea cap that is positioned over and resting on the top of the subsea structure and having at least one port in the subsea cap, a canister for exterior attachment or connection to the at least one port into the area, and material releasably contained within the canister that is released from the canister through the at least one port into the area to be treated.

BRIEF DESCRIPTION OF THE DRAWINGS

For a greater appreciation of the nature and advantages of the present invention, detailed illustrations and reference numerals are provided in the following specification and drawings.

DETAILED DESCRIPTION OF PREFERRED EMBODIMENTS

Figure 1:
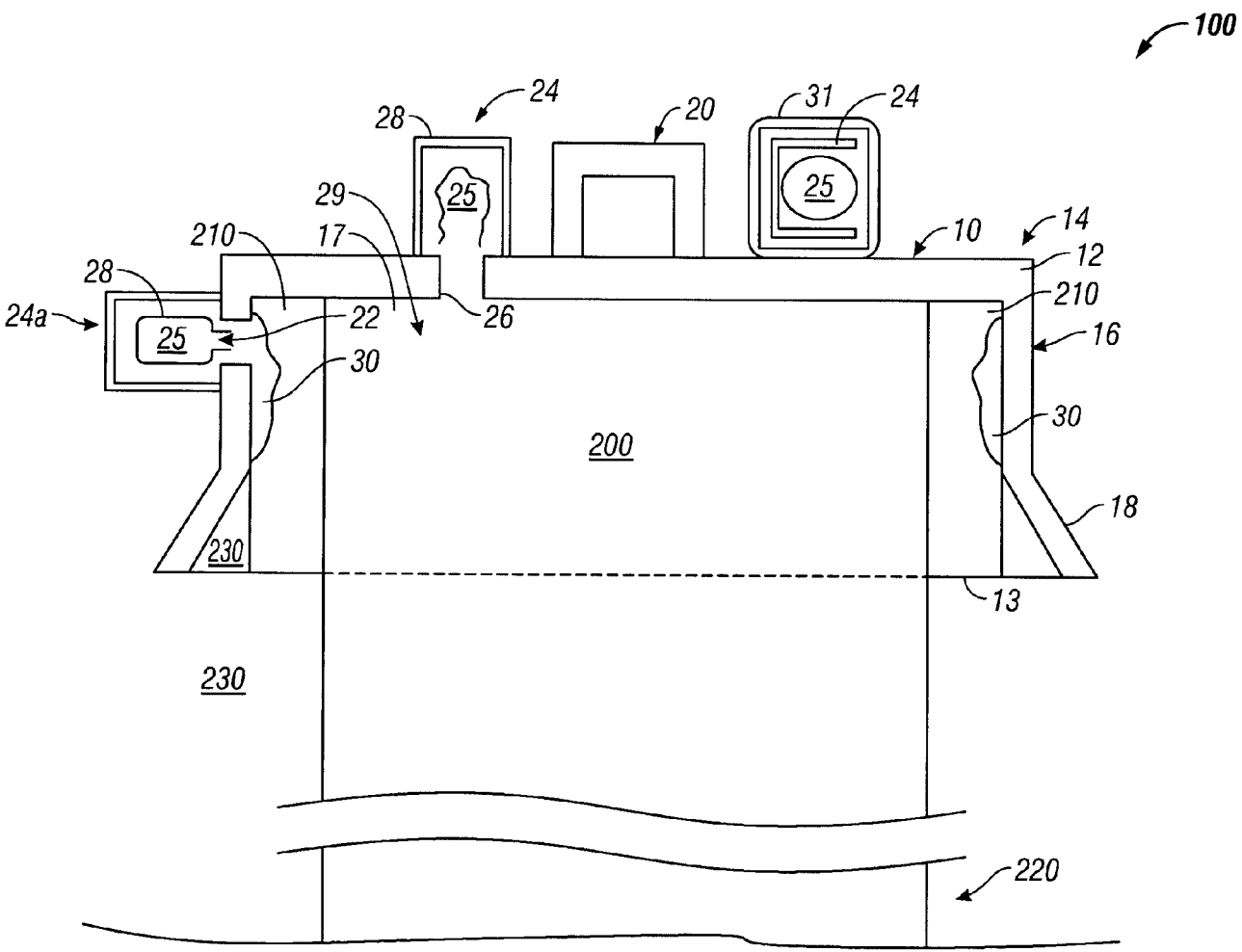
FIG. 1 is a partial side sectional view of one embodiment of a subsea cap system of the present invention having a canister attached to or inserted in the top of the subsea cap and a canister attached to the side of the subsea cap.
Figure 2A:
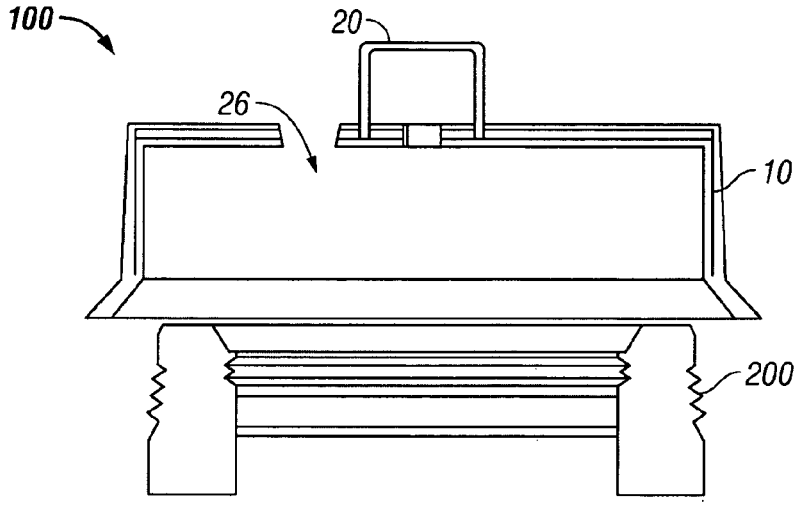
FIG. 2 is a schematic showing steps for installing a canister to the top of a subsea cap system of the present invention.
Figure 2B:
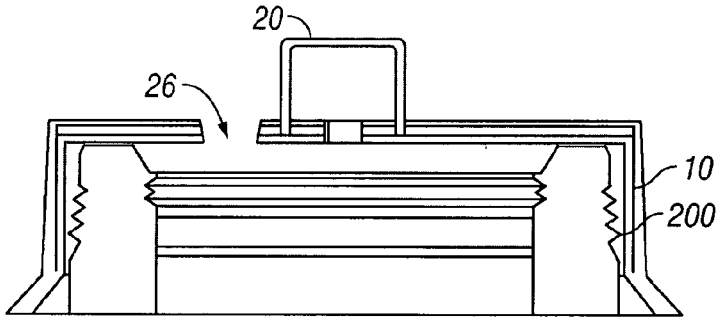
Figure 2C:
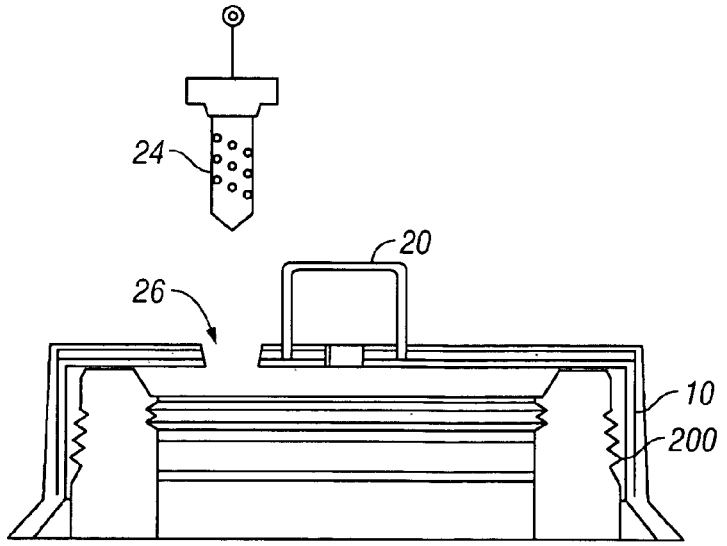
Figure 2D:
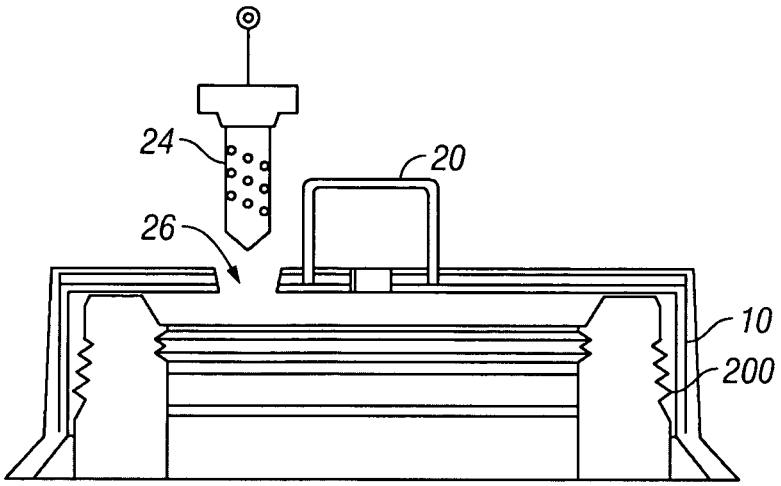
Figure 2E:
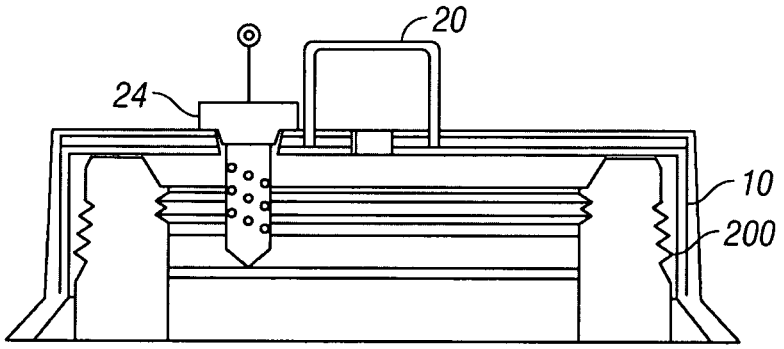
Figure 2F:
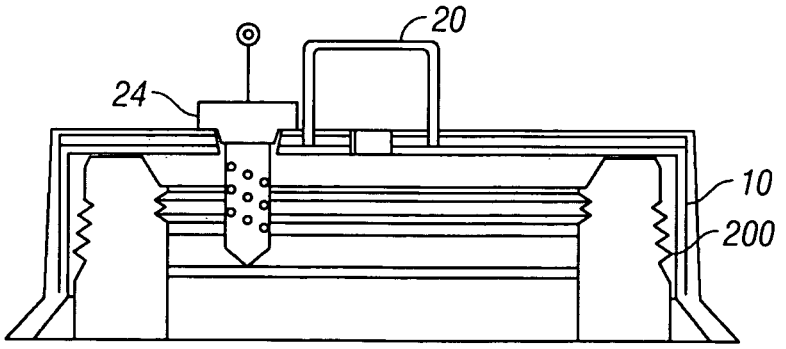
Figure 3A:
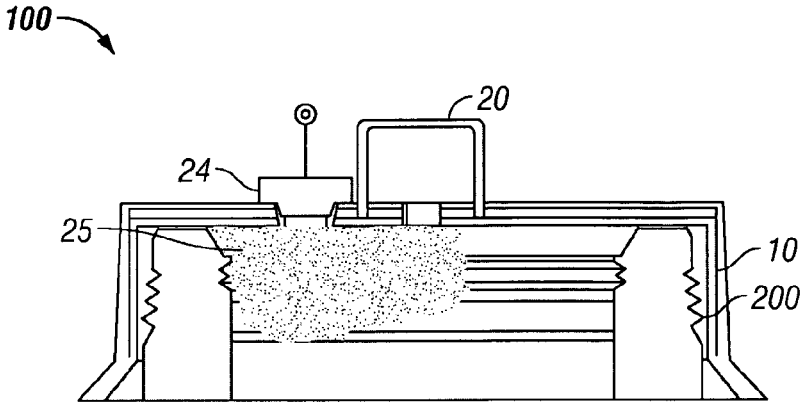
FIG. 3 is a schematic showing steps for replacing a canister at the top of a subsea cap system of the present invention.
Figure 3B:
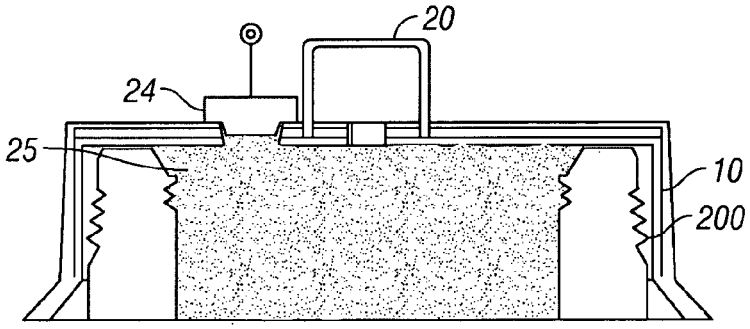
Figure 3C:
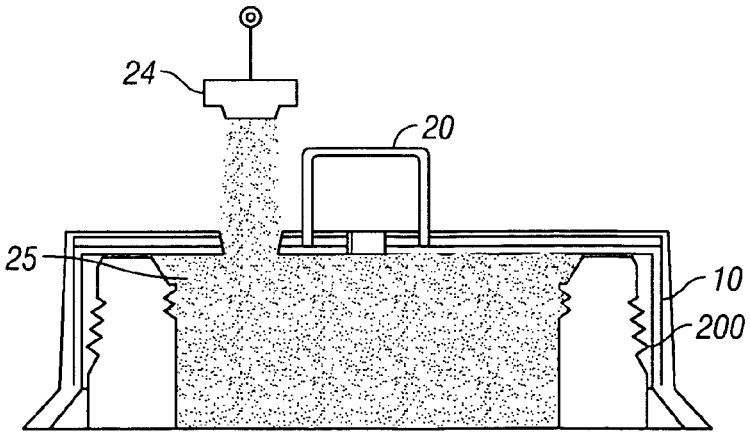
Figure 3D:
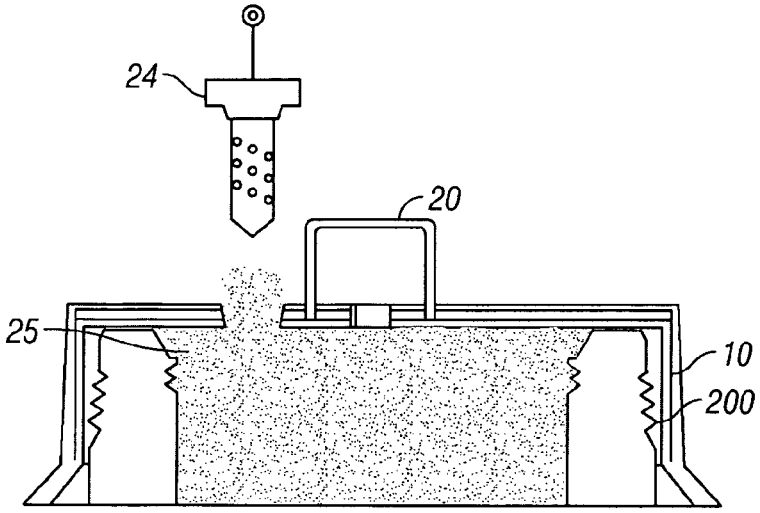
Figure 3E:
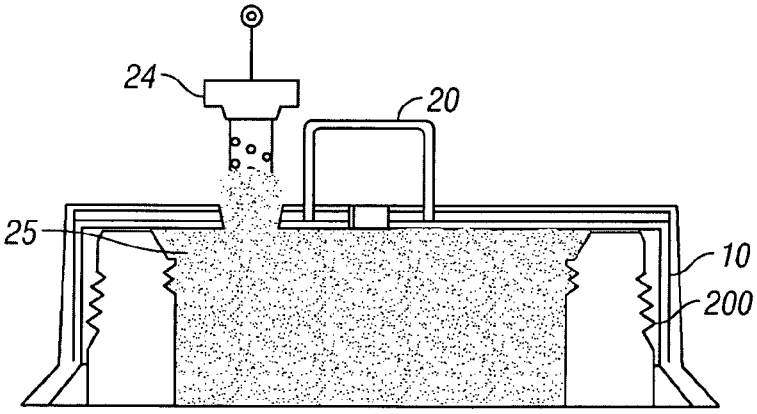
Figure 3F:
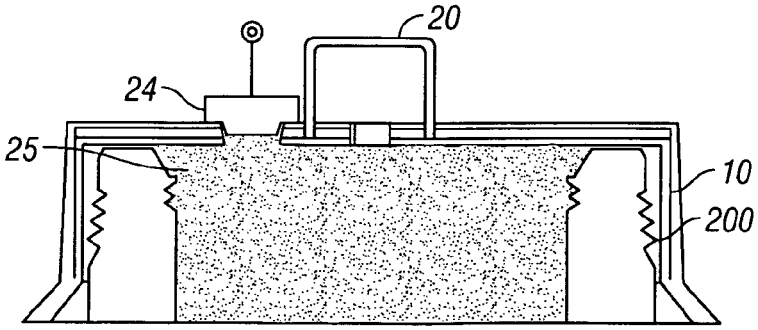

FIG. 1 is a side sectional view of a subsea cap system 100 of the present invention showing a base 14 and a body 16 of a subsea cap 10, a canister 24 and treatment material 25. The body 16 of the cap 10 is open at the bottom and attached to the base 14 at the top 12 of the body 16. The subsea cap 10 can alternatively and most preferably be made in a single piece with the base 14 and body 16 comprising a continuous molded piece as opposed to the two-piece (body/base) one shown in FIG. 1. The base 14 can be of any shape including, but not limited to, round, oval, square, symmetrical, or asymmetrical, as long as the base 14 covers and rests on the open upper end 17 of a subsea structure 200. As depicted in this preferred embodiment, the base 14 is circular, but this is not intended to limit the scope of the invention. The bottom 13 of the body 16 can be made with a flared skirt 18 which can be added to facilitate placement of the subsea cap 10 on the subsea structure 200. The presence or absence of the flared skirt 18 is not meant to limit the functionality or scope of the present invention. In one preferred embodiment (FIG. 1), the subsea cap 10 is defined by the base 14, which is at least slightly larger than the exterior upper end 210 of the subsea structure 200, and the body 16 which projects downward from the base 14 and has sufficient length and width to cover the exterior upper end 210 of the subsea structure 200.

FIG. 1 further displays a handle 20 attached to the base 14 of the cap 10 for assistance in the installation, removal, and positioning of the subsea cap system 100 on the open upper end 17 and exterior upper end 210 of the subsea structure 200. While the handle 20 in FIG. 1 is centrally located on the base 14 of the cap 10, the handle 20 can be placed anywhere on the cap 10 that allows for the desired manipulation capability of the cap 10 by a diver or Remotely Operated Vehicle (ROV) or other manipulation means. Further, while the handle 20 in FIG. 1 is shaped somewhat like an inverted U, the handle 20 may be of differing configurations that allows for the desired manipulation. The presence or absence of the handle 20 is not meant to limit the scope of the invention.

Another component of the subsea cap system 100 is the canister 24 that is detachable or releaseably connected to the port 26 for delivery of the treatment material 25 into the desired space 29 within the subsea cap 10. The canister 24 can be attached or connected to or inserted in the port 26 using industry-known methods that allow for easy installation and detachment (such as threaded, snap, adhesive, gravity, etc). The canister 24 can be made of plastic or any other lightweight material that is suitable for use in sea water. The canister 24 preferably has a protective sheath until it is installed on the subsea cap 10.

The body 16, as illustrated in FIG. 1, also preferably includes at least one port 22. This port 22 allows for connection or attachment to another detachable or releaseably connected canister 24*a* for delivery of treatment material 25 into the desired space 30 beneath the subsea cap 10 and adjacent the exterior upper end 210 of the subsea structure 200.

The canisters 24 and 24*a* are preferably disposable and/or reusable, reloadable, subsea-installable, subsea-removeable, subsea-replaceable and deployable via ROV, diver and other industry used methods. The canister 24 of the preferred embodiment shown in FIG. 1 is attached to the port 26 in the base 14 of the subsea cap 10.

The canister 24 in FIG. 1 is installed in an upright position projecting downward into the port 26 in the base 14 of the subsea cap 10, as depicted in the schematics 2*c*-2*f* in FIG. 2. This is intended as an example and does not limit the scope of the invention as to the position—vertical, horizontal, or otherwise angled. Particularly, FIG. 2 shows placement of the cap 10 on the subsea structure 200 in schematics 2*a* and 2*b*, followed by placement of canister 24 into the port 26 as shown in schematics 2*c*, 2*d*, 2*e*, and 2*f*. These placements are preferably effected with an ROV, not shown. Similarly, the canister 24*a* in the preferred embodiment shown in FIG. 1 is installed in an upright position projecting downward and then horizontally or angularly into the port 22 in the body 16 of the subsea cap 10. The canisters 24 and 24*a* each contain a hollow interior space 28 for transporting the solid, gel, gaseous or liquid form of treatment material 25. The canisters 24 and 24*a* release this treatment material 25 via active injection, passive diffusion, gravity, or other industry methods through the respective ports 26 and 22 respectively either into the water 230 trapped in the space 29 around the upper end 17 of the subsea structure 200 and within/beneath the subsea cap 10, or into the water 230 in the space 30 beneath the subsea cap 10 and adjacent the upper outside portion 210 of the subsea wellhead. Examples of the treatment material 25 include preservation chemicals, biocides, corrosion inhibitors, oxygen scavengers, lubricants, and other industry-known materials. These materials are meant by way of example and are not intended to limit the scope of the invention.

The canisters 24 and 24*a* can be pre-loaded and packaged for shipment or field loaded when needed. One or more of the canisters 24 and/or 24*a* can also be temporarily attached to the subsea cap 10 to be installed (remove the old and install the new), as needed, without removing the subsea cap 10. Such temporary attachment may be effected by simply a tie wrap of a canister 24 or 24*a* to the handle 20 or by placement of a canister 24 or 24*a* in a storage dock 31 on the base 14 or in the body 16 of the subsea cap 10. FIG. 3 shows dispersion of the treatment material 25 from canister 24 in schematic 3*a* and 3*b* (following placement as shown in FIG. 2), removal of canister 24 from cap 10 in schematics 3*c* and 3*d*, and then replacement of the canister 24 on cap 10 in schematics 3*e* and 3*f*. This placement is preferably effected with an ROV, not shown. These subsea methods (install, remove, replace, etc.) that do not disturb the previous treatment can save valuable time and materials. The canisters 24 and 24*a* are not limited by their size or shape and many different sizes and shapes will work. The canisters 24 and 24*a* can also be refillable, if desired.

The canister 24 and/or the canister 24*a* can be installed on the subsea cap 10 prior to the placement of the subsea cap 10 on the subsea structure 200 or after the placement. Preferably, the canisters 24 and 24*a* are releasably attachable to an ROV. A canister 24 and/or canister 24*a* also can be releaseably stored on the subsea cap 10 for later installation. As an example, two canisters 24 are loaded with treatment material 25 and releasably stored in storage port 31 on the subsea cap 10. An ROV, diver or other method delivers the subsea cap system 100 to the subsea site location and installs the subsea cap 10 on the top of the subsea structure 200. One of the canisters 24 is removed from its storage location 31 on the subsea cap 10 and installed in the port 26. The other canister 24 remains releaseably stored on the subsea cap 10. At a later time, the installed canister 24 is removed and the other canister 24 is released from its temporary storage location on the subsea cap 10 and installed in the port 26.

The above descriptions are illustrative only of preferred embodiments and it is understood that one having skill in the art may make various changes to the aforementioned embodiments which do not depart from the spirit and scope of the invention as disclosed herein. Accordingly, the invention is not to be limited except in light of the appended claims.

What is claimed is:

1. A method of protecting the top of a subsea structure during temporary abandonment, the method comprising the steps of:

capping the subsea structure with a temporary abandonment cap comprising at least one port into the top of the subsea structure and attached to said port at least one removable and replaceable canister containing material to provide protection to the top of the subsea structure through said port;

wherein the canister is replaced to provide protection without removing the subsea cap from its resting position on the subsea structure; and wherein the canister releases the material into the top of the subsea structure while the subsea cap is positioned on the subsea structure;

allowing the material in the canister to release into the top of the subsea structure through the port while the cap is resting on the subsea structure;

after the material has likely been diluted or depleted from the top of the subsea structure, replacing the canister with another canister containing material to provide protection to the top of the subsea structure, without removing the subsea cap from its resting position on the subsea structure; and allowing the material in said another canister to release into the top of the subsea structure through the port while the cap is resting on the subsea structure.

2. The method of claim 1 wherein said another canister remains in a protective sheath until such canister is attached to the port of the subsea cap for release of the material into the top of the subsea structure.

* * * * *